United States Patent [19]

Singerman

[11] 4,319,981

[45] Mar. 16, 1982

[54] PROCESS FOR PREPARING A LIQUID FUEL COMPOSITION

[75] Inventor: Gary M. Singerman, Monroeville, Pa.

[73] Assignee: The United States of America as represented by the United States Department of Energy, Washington, D.C.

[21] Appl. No.: 205,223

[22] Filed: Nov. 12, 1980

[51] Int. Cl.[3] ..... C10G 1/00

[52] U.S. Cl. ..... 208/8 R; 44/53; 44/77; 208/263; 568/630

[58] Field of Search ..... 208/8 R, 263; 44/53; 568/630

[56] References Cited

U.S. PATENT DOCUMENTS 4,256,568 3/1981 Schlosberg et al. ..... 208/263
4,277,327 7/1981 Schlosberg et al. ..... 208/263

FOREIGN PATENT DOCUMENTS 79302082 4/1980 European Pat. Off. .
600837 4/1948 United Kingdom .

OTHER PUBLICATIONS

NACA-Wartime Report "Knock Limited Performance of Pure Hydrocarbon Blended with a Base Fuel In a Full Scale Aircraft-Engine Cylinder; III-Four Aromatics, Six Elters", Mar. 1946.

*Primary Examiner*—Winston A. Douglas
*Assistant Examiner*—J. V. Howard
*Attorney, Agent, or Firm*—Deane E. Keith; Forrest D. Stine; Joseph J. Carducci

[57] ABSTRACT

A process for preparing a liquid fuel composition which comprises liquefying coal, separating a mixture of phenols from said liquefied coal, converting said phenols to the corresponding mixture of anisoles, subjecting at least a portion of the remainder of said liquefied coal to hydrotreatment, subjecting at least a portion of said hydrotreated liquefied coal to reforming to obtain reformate and then combining at least a portion of said anisoles and at least a portion of said reformate to obtain said liquid fuel composition.

23 Claims, No Drawings

PROCESS FOR PREPARING A LIQUID FUEL COMPOSITION

The Government of the United States of America has rights in this invention pursuant to contract No. DE-ACO1-79CS50022 by the U.S. Department of Energy to Gulf Research & Development Company, a subsidiary of Gulf Oil Corporation.

BACKGROUND OF THE INVENTION

1. Field of the Invention

This invention relates to a process for preparing a liquid fuel composition which comprises liquefying coal, separating a mixture of phenols from said liquefied coal, converting said phenols to the corresponding mixture of anisoles, subjecting at least a portion of the remainder of said liquefied coal to hydrotreatment, subjecting at least a portion of said hydrotreated liquefied coal to reforming to obtain reformate and then combining at least a portion of said anisoles and at least a portion of said reformate to obtain said liquid fuel composition.

2. Description of the Prior Art

Coal liquids obtained by the hydrogenation of coal promise to be a significant source for hydrocarbons suitable for use in generating energy, for example, as liquid hydrocarbon fuel compositions for spark ignition internal combustion engines. Such coal liquids contain a significant amount of phenolic materials, ranging, for example, from about five to about 30 weight percent, based on the raw coal liquids so produced. If coal liquefaction becomes commercially significant, far more phenolic compounds will probably be produced than can be absorbed by the combined demands of all chemical industries utilizing phenolic materials. It would be highly desirable, therefore, to find other non-chemical industry users for such phenolic materials. It is known, for example, that anisole can be added to gasoline as a non-metallic octane improver. However, phenols in gasoline can be corrosive, can cause gum formation and can cause some plastics and elastomers now in use in automotive gasoline systems to swell, harden and/or crack. Just as important, phenols are poisonous by all routes of entry into the systematic circulation of mammals, absorption through the skin being the primary route of entry into the blood stream. Liquid phenols in contact with the skil can also cause local irritation or chemical burns.

On the other hand, the phenols need not be removed from the raw coal liquid. Instead the total coal liquid product, after removing ash and heavy bottom material therefrom, could be further processed to high quality gasoline blending stock or distillate fuel. Hydrotreatment would, for example, reduce the phenolics of fuel-compatible hydrocarbons. Unfortunately, such hydrotreatment to reduce phenolics to such fuel-compatible hydrocarbons would require severe treating conditions and would consume large amounts of hydrogen.

From a processing point of view refining of coal liquids is greatly hampered by the presence of phenols for the following reasons. As pointed out above, excessive hydrogen consumption is required to reduce the phenols. Phenols are corrosive to processing equipment. The combination of phenols and chlorides, when present, are more corrosive to processing equipment than either one alone. Most coals contain chlorides, thus usually aggravating the corrosion problems. Water produced when phenols are hydroreduced will tend to sinter refinery catalyst supports. The presence of phenols during hydrotreating tends to hamper the ease of nitrogen removal from the coal liquids. For example, the rate constants for removal of nitrogen from phenol-free coal liquids by hydrotreatment can be increased by a factor of six at 375° to 400° C. compared to the same coal liquids containing the phenols. The significance of the increased hydrodenitrogenation rate constants is that the reactor can be smaller for a given capacity or more throughput can be obtained at milder conditions, both of which can result in lower operating costs.

SUMMARY OF THE INVENTION

The process defined and claimed herein is directed to the preparation of a liquid fuel composition which comprises liquefying coal, separating a mixture of phenols from said liquefied coal, converting said phenols to the corresponding mixture of anisoles, subjecting at least a portion of the remainder of said liquefied coal to hydrotreatment, subjecting at least a portion of said hydrotreated liquefied coal to reforming to obtain reformate and then combining at least a portion of said anisoles and at least a portion of said reformate to obtain said liquid fuel composition.

Operation in accordance with the above dictates gives rise to many unusual and unexpected, but desirable, results. By removing the phenols from the coal liquids prior to hydrotreatment, the problems associated with the hydrotreatment of a liquid hydrocarbon stream containing phenols, as outlined above, are obviated. The phenols recovered herein are not destroyed by passing them through the hydrotreater, but, instead are advantageously used, after conversion to the corresponding anisoles, by incorporating the same in a hydrocarbon fuel composition for spark ignition internal combustion engines. Not only is more hydrocarbon fuel obtained as a result of such operation than would have been obtained if the phenols had otherwise been used or had been permitted to pass through the hydrotreater and had been destroyed, but the hydrocarbon fuel so obtained will have a higher octane number than would the hydrocarbon fuel obtained following such other undesirable procedures.

In the first stage of the process herein coal liquids are obtained by treating coal with hydrogen at elevated temperatures and elevated pressures. For example, the coal liquids can be obtained by heating a slurry composed of finely-divided coal and a carrier, for example, coal liquids produced in the process with hydrogen, without a catalyst, or with a catalyst, such as cobalt molybdate or nickel titanium molybdate, at a temperature in the range of about 400° to about 510° C., preferably about 370° to about 480° C., and a total pressure of about 500 to about 5000 pounds per square inch gauge (about 3445 to about 34,450 kPa), preferably about 1000 to about 4000 pounds per square inch gauge (about 6890 to about 27,560 kPa), for about 0.10 to about two hours, preferably about 0.25 to about 1.5 hours. A process particularly preferred for obtaining the coal liquids involves passing the feed coal, hydrogen and recycle solvent through a preheater at a temperature of about 315° to about 430° C. and a total pressure of about 1000 to about 4000 pounds per square inch gauge (about 6890 to about 27,560 kPa) over a period of about 1.5 to about 30 minutes, introducing the preheated mixture to a dissolver zone, wherein the temperature is maintained in the range of about 370° to about 480° C. and the pressure is maintained in the range of about 1000 to about 4000 pounds per square inch gauge for about 0.25 to about 1.5 hours sufficient to dissolve or liquefy at least a portion of the coal, separating from the liquefied coal product hydrocarbon gases, ash (mineral matter originally in the coal), liquefied coal and deashed solid coal and recycling a portion of the liquefied coal as recycle solvent. In order to improve liquefaction and to increase the ratio of liquefied coal to deashed solid coal, some of the ash obtained can be recycled to the dissolver, or hydrocracking, zone. In still another embodiment, hydrogenation of the coal need not be carried out with free hydrogen, but, instead, the recycle solvent can be hydrogenated prior to introduction into the dissolver. In this way the solvent will become a hydrogen donor and will supply the hydrogen necessary for hydrocracking and desired liquefaction. Examples of processes suitable for obtaining coal liquids for use herein can be found in U.S. Pat. Nos. 4,159,238 to Schmid, 3,341,447 to Bull et al, 3,884,795 to Wright et al, 4,110,192 to Hildebrand et al, 3,957,619 to Chun et al, 3,997,426 to Montagna et al, 4,082,282 to Cronauer et al, 4,081,361 to Hildebrand et al, 4,116,808 to Cronauer et al and 4,190,518 to Gianetti et al.

From the coal liquids so obtained there is recovered a fraction containing phenols, said fraction having a boiling point at atmospheric pressure (ambient pressure) of about 55° to about 250° C. This can be done in any suitable manner, preferably by simple distillation at atmospheric pressures. The bottoms can be recovered and used in any suitable manner or discarded.

The recovery of the mixture of phenols present in the fraction obtained above can be effected in any desired manner, for example, by solvent extraction or caustic extraction. Thus, the coal liquid fraction can be treated with at least one molar equivalent, preferably from about 1.1 to about 1.5 molar equivalents, relative to the phenols, of an aqueous caustic (sodium hydroxide) solution having a concentration of about five to about 80 percent, preferably about 10 to about 30 percent, with stirring, for about one minute to about four hours, preferably about 30 minutes to about one hour, at atmospheric temperature and atmospheric pressure. The mixture will then separate into an upper neutral hydrocarbon layer and a lower aqueous caustic layer containing the sodium phenolic salts. The two layers are then separated from each other, for example, by decantation. The desired phenolic mixture can then be recovered from the lower layer, for example, by contacting the same with at least the molar equivalent of a mineral acid, such as hydrochloric acid or sulfuric acid, or a carboxylic acid, such as acetic acid or carbonic acid, at atmospheric temperature and atmospheric pressure. The resulting mixture will comprise an upper phenolic layer and a lower aqueous layer, which can be separated from each other in any suitable manner, for example, by decantation.

The separated phenols so recovered can be converted to the corresponding anisoles in any suitable or convenient manner. This can be done, for example, by standard chemical methanation techniques. Thus, an aqueous solution of the sodium salts of the phenolic mixture can be contacted, while stirring, with at least the molar equivalent, preferably about 1.05 to about 2.0 molar equivalents, of dimethyl sulfate or methyl chloride at atmospheric temperature and atmospheric pressure. If any excess dimethyl sulfate is present, it can be destroyed by reaction with caustic. The upper anisole layer can then be recovered from the lower aqueous layer, for example, by decantation. When methyl chloride is used, the resulting bottom layer is separated by decantation, leaving behind the top anisole layer. Methyl chloride, if present in the top layer, can be removed therefrom by simple distillation. Left behind will be a novel anisole mixture, which is claimed alone or in admixture with a liquid hydrocarbon fuel composition in my copending application, Ser. No. 205224 entitled Novel Anisole Mixture and Liquid Hydrocarbon Fuels Containing the Same, filed concurrently herewith. Reference to other procedures for preparing anisoles can be obtained from Encyclopedia of Chemical Technology, Second Edition, Volume 15, Interscience Publishers, New York City, N.Y. (1968), pages 165 and 166, particularly by treating the mixture of phenols with methanol over catalysts, such as alumina and silica, following the procedure of British Pat. Nos. 600,837 and 600,835.

The remainder of the coal liquids, substantially free of phenols, ash and bottoms, is then sent to a hydrotreater wherein it is treated in the presence of hydrogen at elevated temperatures and pressures following any suitable hydrotreating procedures for the purpose of removing substantially all of the nitrogen, sulfur, olefinic and diolefinic unsaturation, oxygen, etc. Thus, in the hydrotreater the temperature can be on the order of about 290° to about 450° C., preferably about 315° to about 420° C., the total pressure in the range of about 500 to about 3000 pounds per square inch gauge (about 3447 to about 20,682 kPa), preferably in the range of about 750 to about 2500 pounds per square inch gauge (about 5170 to about 17,235 kPa), and the hydrogen partial pressure in the range of about 400 to about 2500 pounds per square inch absolute (about 2758 to about 17,235 kPa), preferably about 630 to about 2100 pounds per square inch absolute (about 4333 to about 14,477 kPa). The feed is passed over any suitable hydrotreating catalyst, for example, one containing a metal from Group VI or Group VIII of the Periodic Table, such as nickel-molybdenum on aluminum silicate, at a liquid hourly space velocity of about 0.25 to about 10, preferably about 0.40 to about 8.0. Lower-boiling hydrocarbons in the $C_1$ to $C_4$ range can be removed from the hydrotreated product in any suitable manner, for example, by flashing, followed by fractionation. If desired, at least some of the aromatics, such as benzene, toluene and xylene, can also be removed from the hydrotreated product, for example, by fractionation.

The hydrotreated material is then sent to a reformer wherein under any suitable reforming conditions the hydrocarbons therein are upgraded, primarily by dehydrocyclization and also by isomerization, to $C_5+$ hydrocarbons boiling in the gasoline boiling range. Thus, using conventional reforming catalyst, such as platinum-alumina or multi-metallic reforming catalyst, such as platinum-rhenium-aluminum catalyst, temperatures can be on the order of about 370° to about 565°, preferably about 400° to about 540° C., and the total pressure about 50 to about 500 pounds per square inch gauge (about 345 to about 3447 kPa), preferably about 100 to about 400 pounds per square inch gauge (about 689 to about 2758 kPa). Liquid hourly space velocity can be in the range of about 0.25 to about 10, preferably about 0.4 to about 8.0. The hydrogen to hydrocarbon feed molar ratio can range from about 2:1 to about 12:1, preferably about 3:1 to about 10:1. Examples of suitable hydrotreating and reforming operations suitable for use herein can be found in U.S. Pat. Nos. 3,776,836 to Ko et al and 4,162,961 to Marmo. The reformate so produced, after removal of light gases therefrom, will comprise $C_5+$ hydrocarbons boiling in the gasoline boiling range at atmospheric pressure from about 35° to about 230° C.

The octane rating of the reformate so produced can be increased by then adding thereto at least a portion of the anisole mixture previously obtained from the phenols present in the original coal liquids. The resulting blend can contain, for example, from about one to about 25 weight percent of the anisole mixture, preferably from about three to about 15 weight percent of the anisole mixture. If desired, other additives normally incorporated in liquid fuel compositions for other purposes, such as rust inhibitors, oxidation inhibitors, anti-icers, detergents, etc., in the amount of about 0.5 to about 500 pounds per thousand barrels, based on the initial liquid fuel composition, can also be incorporated therein.

The anisole mixture obtained in the process herein will include anisole itself,

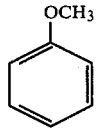

(I)

and a mixture of alkyl anisoles defined by the following formula:

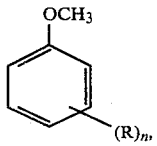

(II)

wherein R is a straight or branched chain alkyl substituent, preferably straight, having from one to four carbon atoms, preferably from one to three carbon atoms, and n is an integer from 1 to 4, preferably from 1 to 3, said mixture of anisoles having a boiling point at atmospheric (ambient) pressure of about 155° to about 230° C., preferably about 155° to about 220° C., the number of individual anisoles in said mixtures of anisoles being about eight to about 30, generally about ten to about 20. In general the weight percent of anisole itself in such anisole mixture will be from about one to about 25 weight percent, generally from about three to about 20 weight percent, with the remainder being substantially the mixtures of alkyl anisoles defined above.

More specifically the novel anisole mixture will include from about one to about 25 weight percent, generally from about three to about 20 weight percent, of anisole itself,

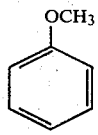

(I) ;

from about one to about 25 weight percent, generally from about three to about 20 weight percent, of monomethyl anisoles defined by the following formula:

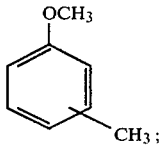

(III)

from about 0.5 to about 20 weight percent, generally from about one to about 15 weight percent, of dimethyl anisoles defined by the following formula:

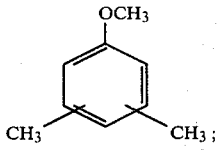

(IV)

from about 0.5 to about 20 weight percent, generally from about one to about 15 weight percent, of trimethyl anisoles defined by the following formula:

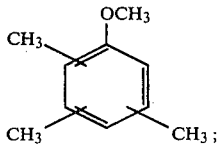

(V)

from about 0.5 to about 20 weight percent, generally from about one to about 15 weight percent of ethyl anisoles defined by the following formula:

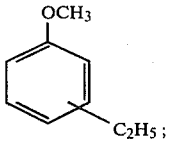

(VI)

from about 0.0 to about five weight percent, generally from about 0.0 to about two weight percent of diethyl anisoles defined by the following formula:

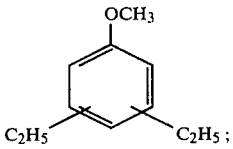

(VII)

from about 0.3 to about 20 weight percent, generally from about 0.5 to about 15 weight percent of propyl (normal propyl or isopropyl) anisoles defined by the following formula:

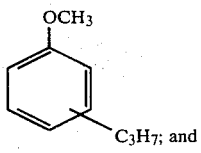

(VIII)

from about 0.0 to about 15 weight percent, generally from about 0.5 to about 10 weight percent, of chloroanisoles defined by the following formula:

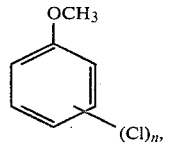

(IX)

wherein n is an integer from 1 to 3, preferably 3.

In the above the alkyl and chloro substituents can be positioned ortho, meta or para relative to the methoxy ($-OCH_3$) group and where two or more alkyl or chloro groups are present they can be positioned ortho, metal or para relative to each other.

DESCRIPTION OF PREFERRED EMBODIMENTS

That a mixture of phenols can be recovered from coal liquids, converted to the corresponding anisoles and that such anisoles can be incorporated in a gasoline produced in part, from hydrotreating and reforming operations is seen from the following. Tables I and II below show the phenols present in coal liquids obtained from the hydrogenation of coal wherein the hydrogenation was carried out at temperatures in the range of about 360° to about 438° C. and at hydrogen partial pressures of about 1000 to about 4000 pounds per square inch gauge (about 6890 to about 27560 kPa) in the presence of ash previously separated from the liquid coal hydrogenation product. In Table I phenols were obtained from a cut boiling in the range of about 55° to about 249° C. at atmospheric pressure of coal liquids obtained from the hydrogenation of Eastern Bituminous Coals. In Table II the coal used was identified as Ireland Mine Coal, Pitt Seam No. 8, West Virginia, and the cut employed had a boiling point range at atmospheric pressure of about 55° to about 249° C.

TABLE I

| Phenolic Compound | Weight Per Cent of Cut |
|---|---|
| Phenol | 5.58 |
| Ortho-Cresol | 2.31 |
| Meta-Cresol | 3.65 |
| Para-Cresol | 2.30 |
| 2,4-Dimethylphenol | 0.77 |
| 2,5-Dimethylphenol | 0.38 |
| 2,6-Dimethylphenol | 0.20 |
| 3,4-Dimethylphenol | 0.12 |
| 3,5-Dimethylphenol | 0.82 |
| Ortho-Ethylphenol | 0.32 |
| Para-Ethylphenol | 0.91 |
| 2-Isopropylphenol | 1.86 |
| Unidentified Phenols | 5.48 |

TABLE II

| Phenolic Compound | Weight Per Cent of Cut |
|---|---|
| Phenol | 4.70 |
| Meta- and Para-Cresols | 6.06 |
| Ortho-Cresol | 1.40 |
| 3,4-Dimethylphenol | |
| 3,5-Dimethylphenol | 0.30 |
| 2,3-Dimethylphenol | 1.30 |
| 2,5-Dimethylphenol | |
| 2,4-Dimethylphenol | 3.60 |
| 3-Ethylphenol | |
| 4-Ethylphenol | |
| 2-Ethylphenol | 0.50 |
| 1-Naphthol | 0.01 |
| 2,3,5-Trimethylphenol | |
| 2,3,6-Trimethylphenol | 0.02 |
| 2,4-Dichlorophenol | |
| 2,4,6-Trimethylphenol | |

TABLE II-continued

| Phenolic Compound | Weight Per Cent of Cut |
|---|---|
| 4-Isopropylphenol | 0.94 |
| 2-Isopropylphenol | 1.07 |
| Para-Phenylphenol | 0.01 |
| Para-Tertiarybutylphenol | 0.17 |
| 2,4,6-Trichlorophenol | 0.20 |
| 2,4,5-Trichlorophenol | 0.57 |

The mixture of anisoles employed herein was obtained as follows. A composite of raw coal liquid from fifty-one coal liquefaction runs on Eastern bituminous coals carried out at temperatures in the range of about 360° to about 438° C. and at hydrogen pressures of about 1000 to about 4000 pounds per square inch gauge (about 6890 to about 27560 kPa) in the presence of ash previously separated from the liquid coal hydrogenation product was used as the phenol source. The fraction of the composite used was that boiling in the range of 55° to 260° C. This composite fraction, amounting to 7574 pounds (344 kilograms), was divided into two portions and each portion was extracted with 356 pounds (162 kilograms) of 20 percent aqueous sodium hydroxide at 35° C. with stirring over a period of six hours. The lower aqueous layer, having a pH of 10, containing the sodium salts of the phenols was separated from the top neutral layer. The lower basic aqueous layers from the two extractions were combined and washed by stirring with 1185 pounds (538 kilograms) of diethyl ether for six hours at 20° C. to remove non-phenolic organic compounds therefrom. The top ether layer was separated and discarded. The lower aqueous layer was checked for non-phenolic, neutral hydrocarbons by a small-scale extraction of an aliquot with ether and found to contain insignificant amounts. The basic, aqueous layer was then stripped of residual ether to a pot temperature of 55° C. with stirring.

The basic, aqueous layer (still containing the sodium salts of the phenols) was then acidified with aqueous 20 percent hydrochloric acid to a pH of 2 with stirring and cooling to maintain a temperature of 20° C. in the reactor, thus converting the sodium salts of the phenols to free phenols. Sodium chloride, in an amount of 500 pounds (230 kilograms), was added to decrease the solubility of the free phenols in the water. After two hours to allow complete phase separation into a lower aqueous phase and an upper phenols phase, the lower aqueous layer was checked by gas chromatography for phenols, but none was found. The lower aqueous layer was then discarded. The remaining phenolic layer was washed twice with a mixture of 415 pounds of water (188 kilograms), 100 pounds of sodium carbonate (45 kilograms) and 50 pounds of sodium chloride (23 kilograms). The lower wash layer was discarded after it was found by gas chromatography to be free of phenols. The mixture of phenols obtained are believed to be similar to those identified in Table I above.

At this point there was found 2180 pounds (990 kilograms) of phenolics. Of this 1850 pounds (840 kilograms) of the phenolic mixture was used in the conversion to the corresponding anisole mixture, hereinafter referred to as "AM". To the phenolic mixture there was added 1200 pounds (545 kilograms) of 50 percent aqueous sodium hydroxide and 1200 pounds (545 kilograms) of water, sufficient to give a 25 weight percent aqueous sodium hydroxide solution. The reaction mixture was stirred with cooling (18° C.) for eight hours and then 2200 pounds (1000 kilograms) of dimethyl sulfate was added thereto with stirring over a period of 10 hours while maintaining the temperature below 34° C. The reaction mixture was then stirred at 20° C. for 36 hours. To the reaction mixture there was then added 127 pounds (58 kilograms) of aqueous 50 percent sodium hydroxide to destroy excess dimethyl sulfate and to remove any unetherified phenols from the crude AM product. The mixture was stirred one hour, allowed to separate into two layers and the lower, aqueous basic phase was discarded. The remaining AM product layer was washed with a mixture of 415 pounds (188 kilograms) of water, 159 pounds (72 kilograms) of 50 percent aqueous sodium hydroxide and 25 pounds (11 kilograms) of sodium chloride. The lower, aqueous wash layer was discarded to give 1801 pounds (820 kilograms) of AM. The crude AM was distilled to give 65 pounds (30 kilograms) of non-Am-containing first cut (boiling point 44° to 69° C. at 58 to 100 mm. Hg), 1440 pounds (660 kilograms) of AM (boiling point 73° to 117° C. at 30 to 50 mm Hg) and 99 pounds (45 kilograms) of a heavy, dark residue. The AM so obtained is characterized below in Table III.

TABLE III

| Inspection: | |
|---|---|
| Density, 20° C., D 941, g/ml | 0.9807 |
| Carbon, Weight Per Cent | 79.60 |
| Hydrogen, Weight Per Cent | 8.61 |
| Nitrogen, Weight Per Cent | 0.15 |
| Oxygen, Weight Per Cent | 12.39 |
| Distillation, D86, 760 mm | |
| Over: °C. | 140 |
| End: °C. | 226 |
| 5 Per Cent at: °C. | 168 |
| 10 Per Cent | 171 |
| 20 Per Cent | 173 |
| 30 Per Cent | 176 |
| 40 Per Cent | 177 |
| 50 Per Cent | 180 |
| 60 Per Cent | 183 |
| 70 Per Cent | 187 |
| 80 Per Cent | 193 |
| 90 Per Cent | 202 |
| Recovery: Per Cent | 99.5 |
| Residue: Per Cent | 0.5 |

Samples of the above AM product were also analyzed for nuclear magnetic resonance spectrum, gas chromatography and infrared spectrum. The nuclear magnetic resonance and infrared spectra showed absorptions expected for a mixture of anisoles corresponding to a mixture of phenols as shown in Table I above, but did not show the presence of free, unreacted phenols. Gas chromatography also showed an absence of free phenols in the AM product.

The above AM product was blended at five volume percent with a commercial unleaded gasoline. Typical inspections of the base gasoline and the blend are given below in Table IV.

TABLE IV

| Inspection | Base A: (Commercial Unleaded Gasoline) | Base A + Five Volume Per Cent AM |
|---|---|---|
| Gravity, API, D 287 | 58.7 | — |
| Lead in Gasoline, D 3237, G/Gal | <0.005 | — |
| Carbon, Weight Per Cent | 86.82 | — |
| Hydrogen, Weight Per Cent | 13.18 | — |
| Gum, Existent, D 381, Mg/100 Ml | 2 | — |
| Oxidation Stability, D 525, Min | >1440 | — |
| Hydrocarbon Analysis, D 1319, Volume Per Cent | | |
| Aromatics | 26.5 | — |
| Olefins | 13.0 | — |
| Saturates | 60.5 | — |
| Motor Octane Number, D 2700 | 84.1[a] | 84.5[a] |
| Research Octane Number, D 2699 | 93.2[a] | 93.8[a] |
| Vapor Pressure, Reid, D 323: psi | 11.0 | 9.8 |
| Distillation, D 86, 760 mm | | |
| Over: °C. | 28 | 31 |
| End: °C. | 212 | 216 |
| 5 Per Cent At: °C. | 39 | 41 |
| 10 | 44 | 49 |
| 20 | 58 | 64 |
| 30 | 74 | 81 |
| 40 | 89 | 97 |
| 50 | 104 | 111 |
| 60 | 118 | 126 |
| 70 | 131 | 140 |
| 80 | 147 | 156 |
| 90 | 170 | 172 |
| 95 | 192 | 197 |
| Recovery: Per Cent | 97.5 | 98.0 |
| Residue: Per Cent | 1.4 | 1.2 |
| Loss: Per Cent | 1.1 | 0.8 |

[a]Average of two ratings.

The above AM product was also blended at five volume percent with another commercial unleaded gasoline, which had also been prepared from a liquid hydrocarbon stream that had been subjected to hydrotreatment and reforming operations. Typical inspections of the base gasoline and the blend are given below in Table V.

TABLE V

| Inspection | Base B: (Commercial Unleaded Gasoline) | Base B + Five Volume Per Cent AM |
|---|---|---|
| Gravity, D 287: °API | 56.8 | 53.7 |
| Alkalinity: pH | 5.0 | 5.0 |
| Viscosity, D 445, 25° C.: cs | 0.56 | 0.57 |
| Vapor Pressure, Reid, D 323: psi | 10.6 (10.1)[a] | 9.9 |
| Vapor Pressure, D 2551: psi | 10.60 | 10.10 |
| Oxidation Stability, D 525: min | 1440 | 1440 |
| 66° C. (150° F.) Gum Time: mg/100 ml | | |
| 1 day interval unwashed | 2 (2) | 2 |
| 1 day interval washed | 2 (1) | 1 |
| 3 day interval unwashed 3 (3) | 2 | |
| 3 day interval washed 2 (1) | 1 | |
| 6 day interval unwashed | 6 (4) | 3 |
| 6 day interval washed | 6 (2) | 2 |
| Gum, D-381, as received unwashed | 2 (2) | 1 |
| Gum, D-381, as received washed | 1 (1) | 1 |
| Existent Gum, D-381: mg/100 ml | 1 (1) | 1 |
| Copper Dish Gum, D-910: mg/100 ml | 10 (4) | 11 |
| Copper Strip, 50° C. (122° F.), D 130: 3 hr | 1 | 1 |
| Potential Gum, D-873: mg/100 ml | 9 (5) | 4 |
| Distillation, D 86: 760 mm | | |
| Over: °C. | 26 | 25 |

TABLE V-continued

| Inspection | Base B: (Commercial Unleaded Gasoline) | Base B + Five Volume Per Cent AM |
|---|---|---|
| End: °C. | 211 | 211 |
| 5 Per Cent at: °C. | 40 | 41 |
| 10 | 50 | 51 |
| 20 | 66 | 70 |
| 30 | 83 | 88 |
| 40 | 100 | 105 |
| 50 | 116 | 120 |
| 60 | 129 | 134 |
| 70 | 141 | 145 |
| 80 | 152 | 155 |
| 90 | 171 | 174 |
| 95 | 192 | 191 |
| Recovery: Per Cent | 97.9 | 97.9 |
| Residue Per Cent | 1.1 | 1.1 |
| Loss: Per Cent | 1.0 | 1.0 |

[a]Numbers in parentheses are duplicate runs.

Looking at Tables IV and V together, it can be seen that AM is compatible with gasoline. It does not affect significantly the gasoline's specific gravity, distillation curve, alkalinity, viscosity, Reid vapor pressure, oxidation stability, existent gum value, copper dish gum value, copper strip test, or potential gum value. In addition, AM does not separate from gasoline at low temperatures or because of water contamination.

To test the effects of five percent AM in gasoline on plastics and elastomers commonly found in automotive gasoline distribution systems, samples of plastics and elastomers were immersed in Table V base gasoline and in Table V base gasoline containing 5 volume percent AM for five weeks at room temperature. Materials tested were Neoprene, Urethane, Adiprene, Nylon, and Nitrile rubber. Nylon was unaffected by the presence of AM in the gasoline. The other materials swelled somewhat more in the AM/gasoline blend than in the base gasoline but probably little more than would be caused by addition of toluene to the base gasoline. None cracked, hardened, or otherwise deteriorated.

Samples of Table V base gasoline and the Table V base gasoline containing five volume percent AM were studied for mammalian toxicity studies by acute oral toxicity in albino rats, acute dermal toxicity in albino rabbits, and acute vapor inhalation toxicity in rats. Both test samples were found to be relatively harmless to the rat by acute oral exposure and to be practically nontoxic to the rabbit by acute dermal exposure. In the acute vapor inhalation study in rats, body weight gains were within normal limits and necropsy did not reveal any gross pathological alterations. By these tests, the mammalian toxicity of the base gasoline and the base gasoline containing five percent AM was essentially the same.

Microbial contamination of fuels can be a serious problem. To determine whether or not AM in gasoline would increase the incidence of microbial contamination of the gasoline, cultures were prepared in sterile, cotton-stoppered dilution bottles. The aqueous phase consisted of Bushnell-Haas mineral salts medium innoculated with a known number of bacterial cells cultured from contaminated water bottoms from a commercial, unleaded gasoline storage tank. The medium was aseptically dispensed into the bottles in 40, 20, and 4 ml amounts to give (in total culture volumes of 80 ml) aqueous concentrations of 50 percent, 25 percent, and five percent, respectively.

In addition to the five percent AM/base gasoline (Table V), the base gasoline itself and the base gasoline containing a commercially-available fuel-soluble microbicide at the recommended concentration of 270 ppm was also tested. The gasoline formulations were layered over the inoculated medium in the dilution bottles to give a final volume of 80 ml. Cultures were incubated at room temperature in a fume hood. To more closely approximate gasoline storage tank conditions, the samples were not shaken. At intervals of 4, 11, and 18 days, a representative aliquot of the aqueous phase of each culture was aseptically taken, serially diluted, and plated to nutrient agar to ascertain the number of viable bacteria. In each case the bacteria were able to grow in cultures containing 25 percent and 50 percent water. When water in the culture medium was reduced to five percent, growth was inhibited in the culture containing 5 percent AM/gasoline blend and in the culture containing gasoline and the fuel-soluble, commercial microbicide. Bacterial growth was not inhibited in the five percent aqueous culture by base gasoline alone. The AM inhibited growth of the inoculum in the five percent aqueous culture to approximately the same extent as the commercial microbicide. While microbistatic, neither material was microbicidal under these test conditions. Since gasoline storage tanks normally contain less than five percent water, the presence of five percent AM in gasoline will help control bacterial contamination.

Since it is known that anisole itself possesses no appreciable mammalian toxicity (*Industrial Hygiene and Toxicology,* 2nd Revised Edition, Frank A. Patty, Editor, Volume 2, Toxicology, pages 1680, 1681 and 1682), it was not too surprising that the AM mixture herein similarly possessed no appreciable mammalian toxicity. It is also known that anisole is practically without effect on bacterial metabolism (P. Fritsch, et al, *European Journal of Toxicology and Environmental Hygiene,* volume 8, number 3, 1975, pages 169–174). I expected, therefore, that the AM mixture would possess no effective microbistatic properties. It was surprising, then, to find in the above test that the AM mixture possessed desirable microbistatic properties.

A comparison was made of the research octane and motor octane values for the Table IV base gasoline and the Table IV base gasoline containing five, ten and 15 volume percent AM. Based on averaging of duplicate measurements, five percent AM increases octane of 93 RON, 84 MON base gasoline by 0.6 RON and 0.4 MON. At ten percent, AM increases octane by 2.2 RON and 0.9 MON. At 15 percent, AM increases octane of the base gasoline by 3.1 RON and 1.3 MON. This is shown below in Table VI.

TABLE VI

| Gasoline | RON[a] (D 2699) | MON[a] (D 2700) | RON + MON 2 |
|---|---|---|---|
| Base | 93.2 | 84.1 | 88.6 |
| Base + Five Volume Per Cent AM | 93.8 | 84.5 | 89.1 |
| Base + Ten Volume Per Cent AM | 95.4 | 85.0 | 90.2 |
| Base + 15 Volume Per Cent AM | 96.3 | 85.4 | 90.8 |

[a]Average of two ratings.

Using an average RON and MON value, it can be seen from the above that when the gasoline contained 15 volume percent of the novel AM mixture herein, an increase in octane value of almost 2.5 percent was achieved.

I have found, in addition, that the anisole mixture herein produces an increase in the octane number of the gasoline containing the same in excess of the amount that would be expected base on the increase obtained using the same amount of anisole in gasoline. Thus, a series of runs similar to those of Table VI were carried out wherein the gasoline tested in one contained ten volume percent of anisole and in another contained ten volume percent of the same AM employed above. The results are tabulated below in Table VII.

TABLE VII

| Gasoline | MON[a] (D 2699) | RON[1] (D 2700) | RON + MON / 2 | Average Increase |
|---|---|---|---|---|
| Base | 83.60 | 93.50 | 88.55 | — |
| Base + Ten Volume per Cent Anisole | 84.70 | 95.15 | 89.92 | 1.37 |
| Base | 83.10 | 93.15 | 88.12 | — |
| Base + Ten Volume Per Cent AM | 83.95 | 95.40 | 89.67 | 1.55 |

From the above it can be seen that whereas anisole alone improved the octane number of the gasoline by 1.37 units, the novel AM mixture herein improved the octane rating by 1.55 units, about 13 percent more. This is unexpected in view of the prior art. For example, in European patent application Ser. No. 79302082.7 of Roman et al published Apr. 16, 1980, in Table I thereof, it is shown that whether cumylmethyl ether alone, methyltertiarylbutyl ether alone, anisole alone or mixtures of cumylmethyl ether and methyltertiarybutyl ether are incorporated in gasoline, the octane improvement would be about the same in each instance. It was a surprise, therefore, to find that the specific anisole mixture used herein gave rise to improvements in octane value in excess of anisole itself.

The above clearly shows that mixtures of alkyl anisoles obtained from mixtures of phenols present in selected fractions of hydrocarbon liquids derived from the hydrogenation of coal are excellent non-metallic gasoline blending agents and octane improvers possessing unexpected microbistatic properties. Additionally, the phenols present in coal liquids are advantageously employed, the hydrotreating stage is more effectively and economically carried out, larger amounts of liquid hydrocarbon fuels are obtained and said liquid hydrocarbon fuels possess a much higher octane number than the liquid hydrocarbon fuel that would otherwise have been obtained.

Obviously, many modifications and variations of the invention, as hereinabove set forth, can be made without departing from the spirit and scope thereof, and therefore only such limitations should be imposed as are indicated in the appended claims.

We claim:

1. A process for preparing a liquid fuel composition which comprises liquefying coal, separating a mixture of phenols from said liquefied coal, converting said phenols to the corresponding mixture of anisoles, subjecting at least a portion of the remainder of said liquefied coal to hydrotreatment, subjecting at least a portion of said hydrotreated liquefied coal to reforming to obtain a reformate and then combining at least a portion of said anisoles and at least a portion of said reformate to obtain said liquid fuel composition.

2. The process of claim 1 wherein said liquefied coal is obtained by heating coal in the presence of hydrogen in a temperature range of about 400° to about 510° C. and a pressure range of about 500 to about 5000 pounds per square inch gauge.

3. The process of claim 1 wherein said liquefied coal is obtained by heating coal in the presence of hydrogen in a temperature range of about 370° to about 480° C. and a pressure range of about 1000 to about 4000 pounds per square inch gauge.

4. The process of claim 1 wherein said mixture of phenols is obtained from a fraction of liquefied coal having a boiling point range of about 55° to about 250° C.

5. The process of claim 1 wherein said mixture of phenols is converted to the corresponding anisoles by methanation.

6. The process of claim 1 wherein said hydrotreatment is carried out at a temperature of about 290° to about 450° C., a total pressure of about 500 to about 3000 pounds per square inch gauge, a hydrogen partial pressure of about 400 to about 2500 pounds per square inch absolute while passing the feed over a hydrotreating catalyst at a liquid hourly space velocity of about 0.25 to about 10.

7. The process of claim 1 wherein said hydrotreatment is carried out at a temperature of about 315° to about 420° C., a total pressure of about 750 to about 2500 pounds per square inch gauge, a hydrogen partial pressure of about 630 to about 2100 pounds per square inch absolute while passing the feed over a hydrotreating catalyst at a liquid hourly space velocity of about 0.40 to about 8.0.

8. The process of claim 1 wherein said hydrotreatment is carried out at a temperature of about 370° to about 565° C. and a total pressure of about 50 to about 500 pounds per square inch gauge while passing the hydrocarbon feed, and while maintaining a hydrogen to hydrocarbon feed molar ratio of about 2:1 to about 12:1, over a reforming catalyst at a liquid hourly space velocity of about 0.25 to about 10.

9. The process of claim 1 wherein said hydrotreatment is carried out at a temperature of about 400° to about 540° C. and a total pressure of about 100 to about 400 pounds per square inch gauge while passing the hydrocarbon feed, and while maintaining a hydrogen to hydrocarbon feed molar ratio of about 3:1 to about 10:1, over a reforming catalyst at a liquid hourly space velocity of about 0.4 to about 8.0.

10. The process of claim 1 wherein said reformate has a boiling point range of about 35° C. to about 230° C.

11. The process of claim 1 wherein the reformate, after addition thereto of said anisoles, will contain from about one to about 25 weight percent of anisoles.

12. The process of claim 1 wherein the reformate, after addition thereto of said anisoles, will contain from about three to about 15 weight percent of anisoles.

13. The process of claim 1 wherein the anisole mixture contains anisole and a mixture of alkyl anisoles defined by the following formula:

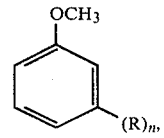

wherein R is a straight or branched chain alkyl substituent having from one to four carbon atoms and n is an integer from 1 to 4, said anisole mixture having a boiling point of about 150° to about 230° C. wherein the number of individual anisoles in said anisole mixture ranges from about eight to about 30.

14. The process of claim 13 wherein R in said alkyl anisoles is a straight chain alkyl substituent.

15. The process of claim 13 wherein R in said alkyl anisoles has from one to three carbon atoms.

16. The process of claim 13 wherein said anisole mixture has a boiling point in the range of about 155° to about 220° C.

17. The process of claim 13 wherein the number of individual anisoles in said anisole mixture ranges from about eight to about 30.

18. The process of claim 13 wherein the number of individual anisoles in said anisole mixture ranges from about ten to about 20.

19. The process of claim 13 wherein the weight percent of anisole in said anisole mixture is in the range of about one to about 25 weight percent.

20. The process of claim 13 wherein the weight percent of anisole in said anisole mixture is in the range of about three to about 20 weight percent.

21. The process of claim 13 wherein the mixture of alkyl anisoles includes monomethyl anisoles, dimethylanisoles, trimethyl anisoles, ethyl anisoles and propyl anisoles.

22. The process of claim 13 wherein the mixture of alkyl anisoles includes about one to about 25 weight percent of monomethyl anisoles, about 0.5 to about 20 weight percent of dimethyl anisoles, about 0.5 to about 20 weight percent of trimethyl anisoles, about 0.5 to about 20 weight percent of ethyl anisoles and about 0.3 to about 20 weight percent of propyl anisoles.

23. The process of claim 13 wherein the mixture of alkyl anisoles includes about three to about 20 weight percent of monomethyl anisoles, about one to about 15 weight percent of dimethyl anisoles, about one to about 15 weight percent of trimethyl anisoles, about one to about 15 weight percent of ethyl anisoles and about 0.5 to about 15 weight percent of propyl anisoles.

* * * * *